US011903457B2

(12) United States Patent
Huang

(10) Patent No.: US 11,903,457 B2
(45) Date of Patent: Feb. 20, 2024

(54) KEY RING HOLDER

(71) Applicant: HOEY CO., LTD., Taoyuan (TW)

(72) Inventor: Chi-Chao Huang, Taoyuan (TW)

(73) Assignee: HOEY CO., LTD., Taoyuan (TW)

( * ) Notice: Subject to any disclaimer, the term of this patent is extended or adjusted under 35 U.S.C. 154(b) by 0 days.

(21) Appl. No.: 17/971,803

(22) Filed: Oct. 24, 2022

(65) Prior Publication Data

US 2023/0131619 A1 Apr. 27, 2023

(30) Foreign Application Priority Data

Oct. 25, 2021 (TW) ..... 110139577
Sep. 22, 2022 (TW) ..... 111135984

(51) Int. Cl.
*A44B 15/00* (2006.01)

(52) U.S. Cl.
CPC ..... *A44B 15/00* (2013.01)

(58) Field of Classification Search
CPC ..... A44B 15/00; A44B 15/005; Y10T 70/873; Y10T 24/205; B42F 1/08
See application file for complete search history.

(56) References Cited

U.S. PATENT DOCUMENTS 1,343,495 A * 6/1920 Davis ..... A44B 15/00 70/458
1,388,100 A * 8/1921 Davis ..... A44B 15/00 70/458
1,619,783 A * 3/1927 Chase ..... B60C 27/06 24/68 TT
2,209,475 A * 7/1940 Rawlings ..... A45F 5/02 24/598.6
2,410,951 A 11/1946 Kuhnl
2,781,566 A * 2/1957 Hammer ..... B42F 1/08 D19/86
2,810,176 A * 10/1957 Gaafar ..... G09F 3/14 24/546
3,657,909 A 4/1972 Boswell
(Continued)

FOREIGN PATENT DOCUMENTS

CN 1224358 10/2005
CN 110811081 A 2/2020
(Continued)

OTHER PUBLICATIONS

Search Report for Application No. TW111135984, dated Jan. 6, 2023.
Search Report for TW110139577.

*Primary Examiner* — Robert Sandy
*Assistant Examiner* — Louis A Mercado
(74) *Attorney, Agent, or Firm* — Jackson IPG PLLC; Demian K. Jackson

(57) ABSTRACT

An integrally formed resilient holder is configured in the form of a two-turn spiral ring body with an elongated configuration. The holder includes an upper loop and a lower loop having a size substantially different from that of the upper loop, such that pivot points are created at which the upper loop and the lower loop intersect each other. In the light of its deformability, the holder can be easily triggered to open up an entry port through which keys or rings may be introduced or removed by a simple press from the user. The holder is of high durability and versatility and is cost-effectiveness accordingly.

10 Claims, 16 Drawing Sheets

(56) References Cited

U.S. PATENT DOCUMENTS

| | | | | |
|---|---|---|---|---|
| 4,191,038 | A | 3/1980 | Vaughn | |
| 4,847,957 | A | 7/1989 | Ranta | |
| 4,891,961 | A * | 1/1990 | Tsamas | A44B 15/00 24/598.5 |
| 5,042,191 | A * | 8/1991 | Fett | A01K 91/04 24/552 |
| 5,465,596 | A | 11/1995 | Park | |
| 6,240,604 | B1 * | 6/2001 | Fox | A44B 19/262 24/429 |
| 8,464,564 | B2 * | 6/2013 | Von Shoultz | A44B 15/00 24/600.9 |
| 10,085,522 | B1 * | 10/2018 | Huang | A44B 15/002 |

FOREIGN PATENT DOCUMENTS

| | | | |
|---|---|---|---|
| DE | 102019210215 | B3 | 8/2020 |
| EP | 0389594 | B1 | 1/1994 |
| JP | 6276463 | B | 1/2018 |
| TW | M401542 | | 4/2011 |
| TW | M551848 | | 11/2017 |
| TW | I664929 | | 7/2019 |
| WO | 1987005193 | A1 | 9/1987 |

* cited by examiner

KEY RING HOLDER

CROSS REFERENCE TO RELATED APPLICATION

This application claims priority to R.O.C. Patent Application No. 110,139,577 filed Oct. 25, 2021 and R.O.C. Patent Application No. 111,135,984 filed Sep. 22, 2022, both of which are hereby incorporated by reference in their entirety.

FIELD OF THE INVENTION

The invention relates to a keyring holder for holding and carrying items, such as rings and keys, and more particularly to a keyring holder having a two-turn spiral ring body which is integrally formed for conveniently and stably holding a number of rings and keys.

BACKGROUND OF THE INVENTION

Ordinary people often carry significant quantities of keys with different functions, including among others, keys for the residence gate and the house door, automobile and motorcycle keys, and office keys. For the sake of conveniently carrying these keys, most people tend to use a keyring to hold the keys together. However, conventional keyrings usually include a circular ring body made of resilient metal material and wound several times, wherein the free ends of the ring body are arranged to tightly abut against the ring body. The users have to open the circular ring body with a great strength for inserting a key thereinto and usually repeat several times before the key is successfully inserted. Although the keyrings of this type are easy to manufacture and cost-effective, they are rather inconvenient to use.

Efforts have been made by the related industry, and several solutions have been proposed to address the above-mentioned problems. U.S. Pat. No. 3,657,909 discloses an integrally formed keyring, which comprises two loops arranged to be substantially coplanar with each other, and the free end of the keyring can be released by pressing the intersecting portion of the loops. European Patent No. 0389594 discloses a keyring comprising a planar base and two holding arms extending outwardly from the base along the same plane. The free ends of the two holding arms are arranged to abut against each other in the upward-downward direction for holding keys. By pressing an actuating mechanism located on the base, the two holding arms are moved upwards and downwards, respectively, to release their free ends for inserting or taking out keys. This keyring, however, has the drawback of having a complicated structure. R.O.C. Patent No. 1664929, R.O.C. Utility Model No. M551848, Japanese Patent No. 6276463, and U.S. Pat. No. 2,410,951 disclose integrally formed keyring holders, each of them having a two-turn spiral circular ring body. These keyrings include an upper loop and a lower loop, both being configured in circular shape and having substantially the same size, so that the upper and lower loops are overlapped with each other, thus lacking versatility in use.

Therefore, there is still a need in the relevant art for an integrally formed keyring holder that is highly versatile in use, simple in structure, and easy to manufacture.

SUMMARY OF THE INVENTION

In response to the above-mentioned need, the inventor has conducted extensive research and development to arrive at the invention. The invention relates to an integrally formed keyring holder, which is configured in form of an elongated, two-turn, spiral-shaped ring body and adapted to be manufactured through conventional wire processing processes. The keyring holder herein comprises an upper loop and a lower loop which substantially differ from each other in terms of size. The upper loop and the lower loop are configured to abut against each other at the intersections to constitute pivot points. In the light of its deformability, the holder herein can be easily levered to open up an entry port, through which keys or rings may be introduced or removed by a simple press from the user. The invention is of high durability and versatility and is adapted for conveniently and stably holding a number of rings and keys accordingly.

Therefore, in one aspect provided herein is a keyring holder, which comprises an integrally formed resilient ring body, wound spirally downwards from the first end portion thereof to constitute an upper loop and continuously extending to coincide with the first end portion and terminated at a second end portion to constitute an elongated lower loop. The ring body comprises a first section constituted by the first end portion and the second end portion, a second section opposite to the first section, and two side sections connecting the first section to the second section. The first end portion and the second end portion are configured to abut against each other in an upward-downward direction when the ring body is not subjected to an external force. The lower loop is substantially greater than the upper loop in terms of areas enclosed thereby and is arranged in contact with the upper loop on the two side sections at two pivot points proximal to the second section. The upper loop is spaced apart from the lower loop by a gap at the second section in the upward-downward direction to constitute a press portion facing towards the second section, so that the first end portion is levered upward to move away from the second end portion as the press portion is forced to move down towards the lower loop.

In a preferred embodiment, the ring body is made from a wire having a substantially constant thickness and a substantially rectangular cross-section throughout its length. In a more preferred embodiment, the wire has a width perpendicular to the thickness and the thickness is substantially less than the width.

In a preferred embodiment, the first end portion and the second end portion are configured so that the first end portion is superimposed over the second end portion. In a more preferred embodiment, the first end portion and the second end portion are both configured in a hook shape with their free ends pointing towards the second section.

In a preferred embodiment, the first end portion is spaced in part from the second end portion in the upward-downward direction to define a separate portion for receiving the insertion of a key. In a more preferred embodiment, the first end portion and the second end portion are outwardly curved at the separate portion.

In a preferred embodiment, the press portion is upwardly curved to keep it away from the lower loop.

In one preferred embodiment, the upper loop and the lower loop are superimposed in the upward-downward direction at the second section, so that the pivot points are located at the junctures of the second section and the two side sections. In another and alternative embodiment, the upper loop and the lower loop are not superimposed in the upward-downward direction at the second section, so that the pivot points are located at the two side sections.

In one preferred embodiment, the two side sections are arranged parallel to each other. In the other embodiment, the two side sections are arranged non-parallel to each other.

BRIEF DESCRIPTION OF THE DRAWINGS

The above, other objects, features, and effects of the invention will become apparent with reference to the description of the following preferred embodiments with the accompanying drawings, wherein.

DETAILED DESCRIPTION OF THE PREFERRED EMBODIMENTS

Unless specified otherwise, the following terms as used in the specification and appended claims are given the following definitions. It should be noted that the indefinite article "a" or "an" as used in the specification and claims is intended to mean one or more than one, such as "at least one," "at least two," or "at least three," and does not merely refer to a singular one. In addition, the terms "comprising/comprises," "including/includes" and "having/has" as used in the claims are open languages and do not exclude unrecited elements. The term "or" generally covers "and/or", unless otherwise specified. The terms "about" and "substantially" used throughout the specification and appended claims are used to describe and account for small fluctuations or slight changes that do not materially affect the nature of the invention.

Figure 1A:
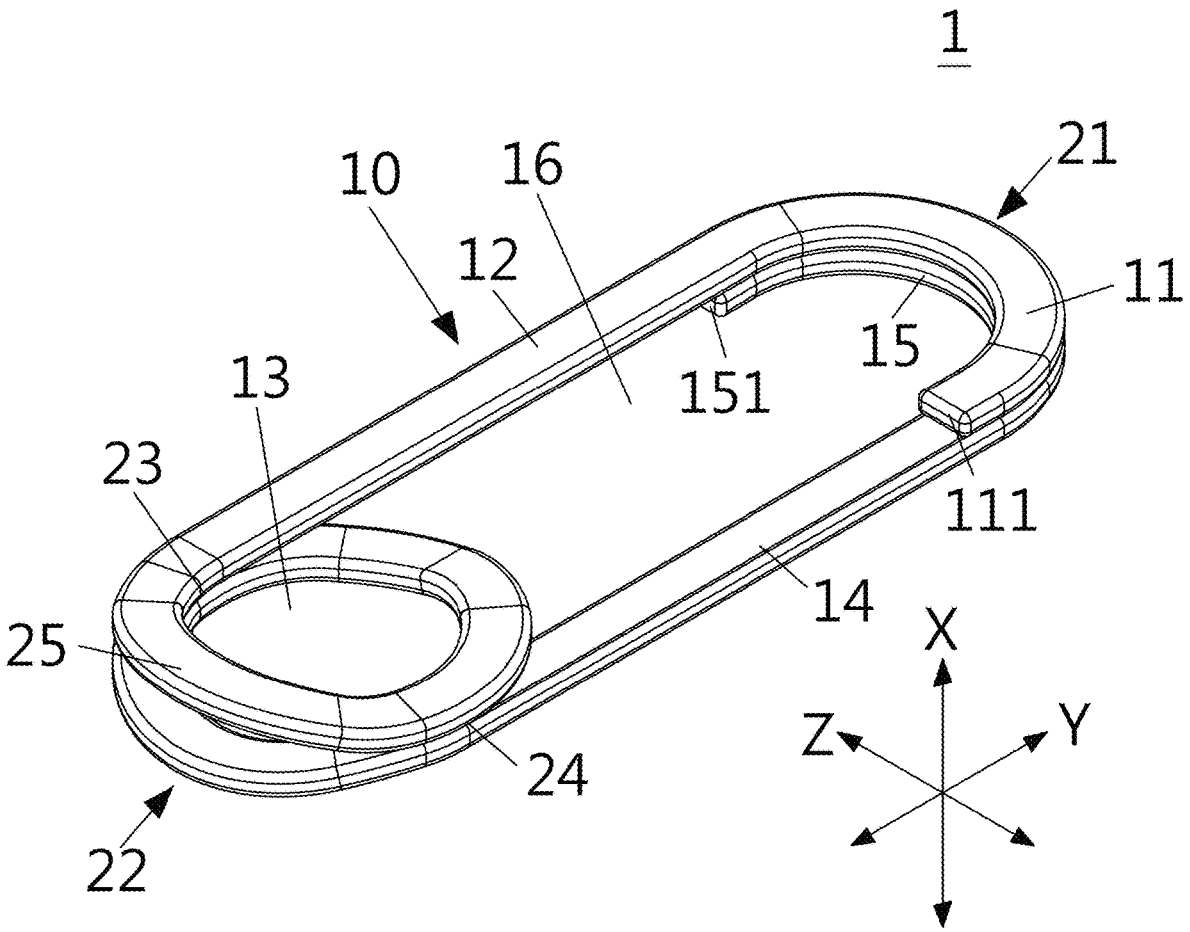
FIG. 1A is a schematic perspective diagram of the keyring holder according to the first embodiment of the invention.
Figure 1B:
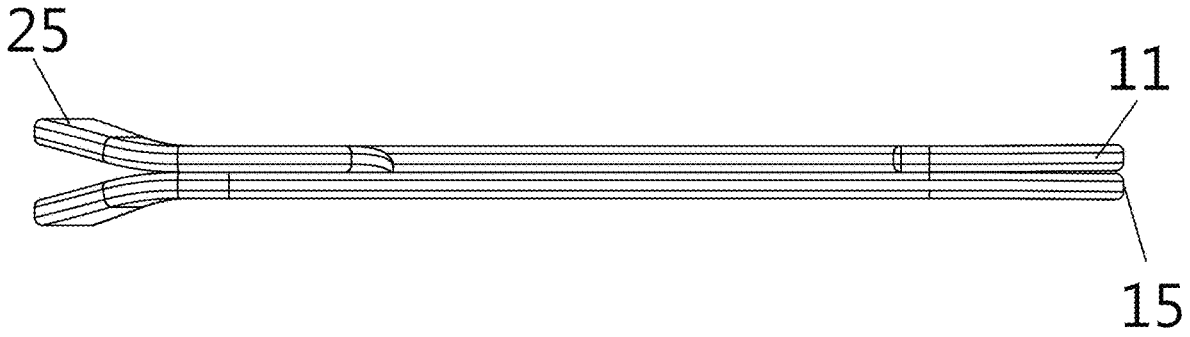
FIG. 1B is a schematic side view of the keyring holder according to the first embodiment of the invention.
Figure 1C:
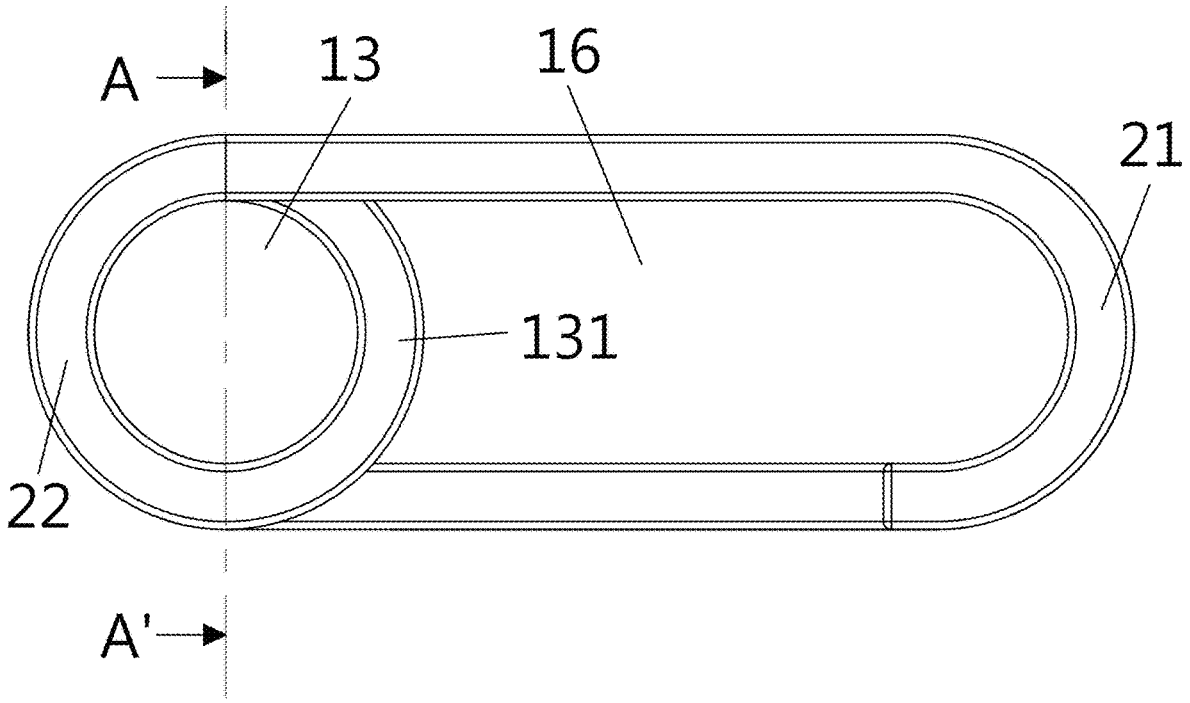
FIG. 1C is a schematic top view of the keyring holder according to the first embodiment of the invention.

FIGS. 1A-1C are schematic diagrams of the first embodiment according to the invention, which show that a keyring holder 1 comprises a ring body 10 made of resilient material. The term "resilient" as used herein may refer to a characteristic of material to be deformed without occurrence of substantial cracks and damages upon application of an external force and that substantially returns to its original dimensions upon release of the force. The material with suitable resiliency includes but is not limited to plastics, metals, and the like. In preferred embodiments, the resilient material may comprise metallic wire material made of stainless steel, brass or zinc alloy, such as that made of type 304 stainless steel. More preferably, the metallic wire material may have a substantially constant thickness and a substantially rectangular cross-section, which may be made into the ring body 10 by using metal die casting, forging, cutting, and electroplating processes. The ring body 10 is integrally formed, which means that it is processed from a single wire. The wire may have a substantially constant thickness and a substantially rectangular cross-section throughout its length. Preferably, the wire has a thickness ranging from about 0.6 mm to about 1.0 mm. More preferably, the wire has a width perpendicular to its thickness in view of its rectangular cross-section, and the thickness is substantially smaller than the width, such that the ring body 10 can keep its resiliency in the upward-downward direction X after being wound up.

According to the first embodiment shown in FIGS. 1A-1C, the ring body 10 is generally an elongated ring body which is wound spirally for two turns. The ring body 10 starts from the first end portion 11 and extends in a straight line along the side section 12. Then, it is wound spirally downwards for one turn and intersects the side section 12 to constitute an upper loop 13. The ring body 10 continues to spin spirally downwards and then extends along a side section 14 which extends in a straight line and is arranged parallel to the side section 12 and intersects with the upper loop 13. Afterwards, the ring body 10 extends to coincide with the first end portion 11 and is terminated at the second end portion 15, thereby constituting an elongated lower loop 16. The term "elongated" as used herein indicates that the wound ring body 10 has a length which is substantially longer than its width. The "elongated" configuration herein may include but be not limited to simple geometrical shapes, such as rectangular-shaped, oval-shaped, and oblong-shaped configurations, and more complex elongated configurations. In this embodiment, the lower loop 16 is configured into a generally oblong shape, so that the ring body 10 is generally in an oblong shape in terms of outer profile. The ring body 10 comprises a first section 21, a second section 22 arranged opposite to the first section 21, and two side sections 12, 14 connecting the first section 21 to the second section 22. Preferably, the oblong-shaped ring body 10 has along axis ranging from 3 cm to 15 cm. The upper loop 13 and the lower loop 16 substantially differ from each other in terms of size, so that they abut against each other at the intersections to constitute pivot points. As shown in FIGS. 1A and 1C, the upper loop 13 is in a substantially circular shape, and the area enclosed by the lower loop 16 is substantially larger than that enclosed by the upper loop 13. The lower loop 16 is arranged in contact with the upper loop 13 on the two side sections 12, 14 at two pivot points 23, 24 disposed proximal to the second section 22. The upper loop 13 is spaced apart from the lower loop 16 by a gap in the upward-downward direction X to constitute a press portion 25 at the upper loop 13 facing towards the second section 22. Preferably, the press portion 25 is configured such that it is upwardly curved to keep it away from the lower loop 16, in a bid to facilitate the user to press with fingers.

According to the invention, the first end portion 11 and the second end portion 15 are configured so that they abut against each other in an upward-downward direction X when the ring body 10 is not subjected to an external force. When the press portion 25 disposed proximal to the second section 22 is forced downwardly to approach the lower loop 16, the first end portion 11 located in the first section 21 is levered to move upwards and away from the second end portion 15 due to the presence of the pivot points 23, 24 (not shown). As a result, the normally closed first section 21 is opened to create an entry port for inserting items, such as keys or rings. Once the pressing force is released from the press portion 25, the first end portion 11 and the second end portion 15 return to their original positions and abut against each other in light of the resiliency of the ring body 10. At this moment, the first section 21 is closed again to prevent the imported keys or rings from being released.

It is worthwhile to note that according to the invention, the pivot points 23, 24 are disposed proximal to the second section 22 and relatively distal to the first end portion 11 and the second end portion which constitute the first section 21. The longer the distance between the first section 21 and the pivot points 23, 24 is, the wider the entry port is created by application of a pressing force to the press portion 25 to move the first end portion 11 away from the second end portion 15. In other words, in the keyring holder 1, the structural feature of distal positioning of the pivot points 23, 24 in relation to the first section 21 works synergistically with the elongated configuration of the lower loop 16, leading to an enlarging effect on the entry port when the press portion 25 is subjected to an external force. Furthermore, taking advantage of the technical feature that the ring body 10 retains resiliency in the upward-downward direction X, when a user is trying to introduce a key or a ring into the keyring holder 1 through the entry port, he/she may further enlarge the entry port by twisting the key or the ring slightly, so as to facilitate the introduction of the key or the ring into the keyring holder 1. In addition, the upper loop 13 and the lower loop 16 differ in size and shape, and the first section 21 is constituted by the first end portion 11 and the second end portion 15, the key or the ring, after passing through the entry port defined by the first end portion 11 and the second end portion 15, can be easily introduced into the lower loop 16 and held stably by sliding it along the first section 21 through less than a half-turn (i.e., <180 degrees). In contrast, in the conventional keyring where the upper and lower loops are both circular in shape and have substantially the same size, a key or a ring, after passing through the entry port, has to slide along the upper loop or the lower loops through at least a full-turn (i.e., about 360 degrees) to enter the double-layered ring body, because the upper and lower loops are generally overlapped in the upward-downward direction.

Figure 2:
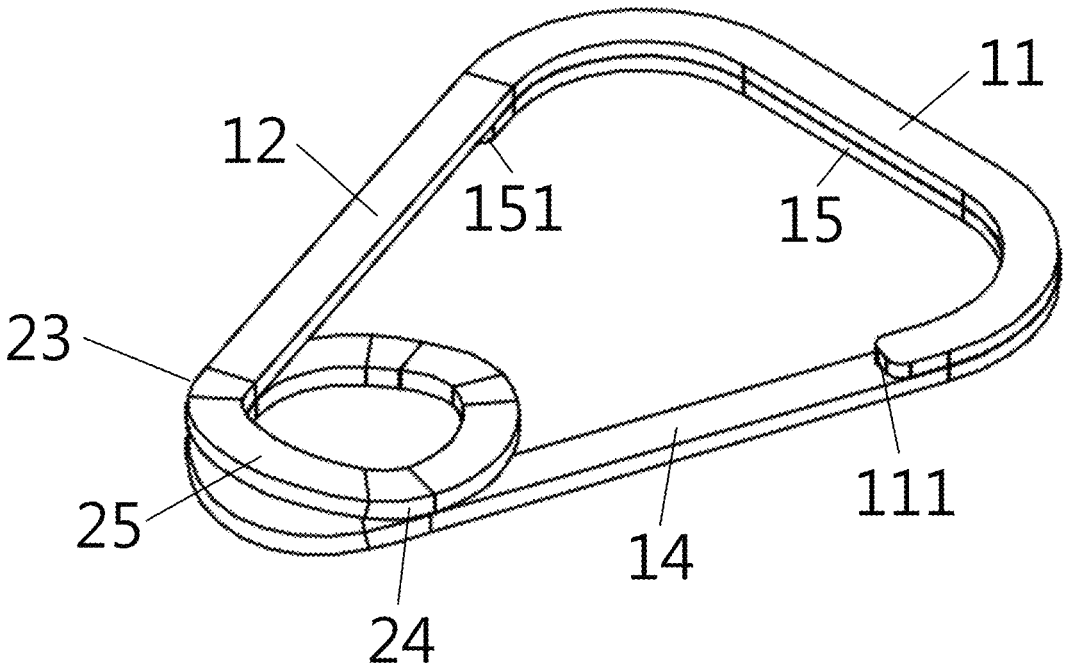
FIG. 2 is a schematic perspective diagram of the keyring holder according to the second embodiment of the invention.

In a preferred embodiment where the keyring holder 1 is suitable for being hung on a shoulder bag or a belt, the first end portion 11 is superimposed over the second end portion 15 when the ring body 10 is not subjected to a force, so that they may increase the mechanical strength of the first section 21 by sharing the weight load from the keys and other items being held. It is worthwhile to note that the first end portion 11 and the second end portion 15 bear the weight load in their width direction. As such, in the preferred embodiment where the ring body 10 is made from a wire having a width substantially greater than its thickness, the first end portion 11 and the second end portion 15 are good at withstanding the weight load and are not easy to deform. More preferably, the first end portion 11 and the second end portion 15 are both configured in a hook shape. The term "hook shape" as used herein may indicate that the first end portion 11 and the second end portion 15 are bent over, with their free ends 111, 151 roughly pointing to the second section 22, thereby providing additional mechanical strength to bear the weight load from the articles being held. There is no limit to the number of the bent portion(s), and the hook-shaped first and second end portions 11, 15 may have many variations. In the first embodiment shown in FIG. 1A, the first end portion 11 and the second end portion 15 are bent once, resulting in an arc-like hook shape. In the second embodiment shown in FIG. 2, the first end portion 11 and the second end portion 15 are bent twice. The bent portion(s) may be either rounded to have a smooth profile as shown in FIGS. 1A and 2, or pointed (not shown). The free end 111 and the free end 151 may properly extend towards the second section 22, but they usually do not physically contact the upper loop 13, so as not to hinder the entry of articles into the entry port.

The side section 12 and the side section 14 may be arranged either substantially parallel to each other, as shown in FIG. 1A, or substantially non-parallel to each other, as shown in FIG. 2. The side section 12 and the side section 14 may not necessarily extend in a straight line and may be curved or irregular in shape, so long as they do not affect the abutment of the upper loop 13 against the lower loop 16 to constitute the pivot points 23, 24 and the leverage effect along the pivot points 23, 24.

Figure 3A:
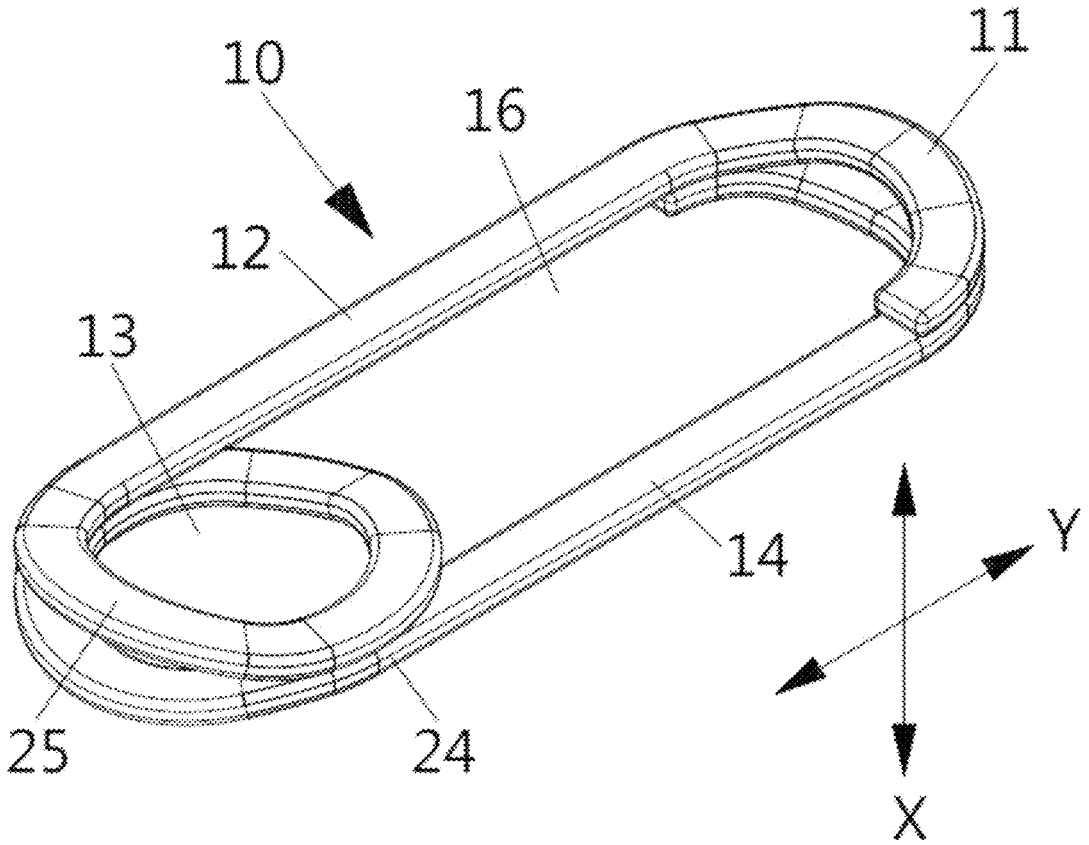
FIGS. 3A-3B are schematic perspective diagrams of the keyring holder according to the third embodiment of the invention.
Figure 3B:
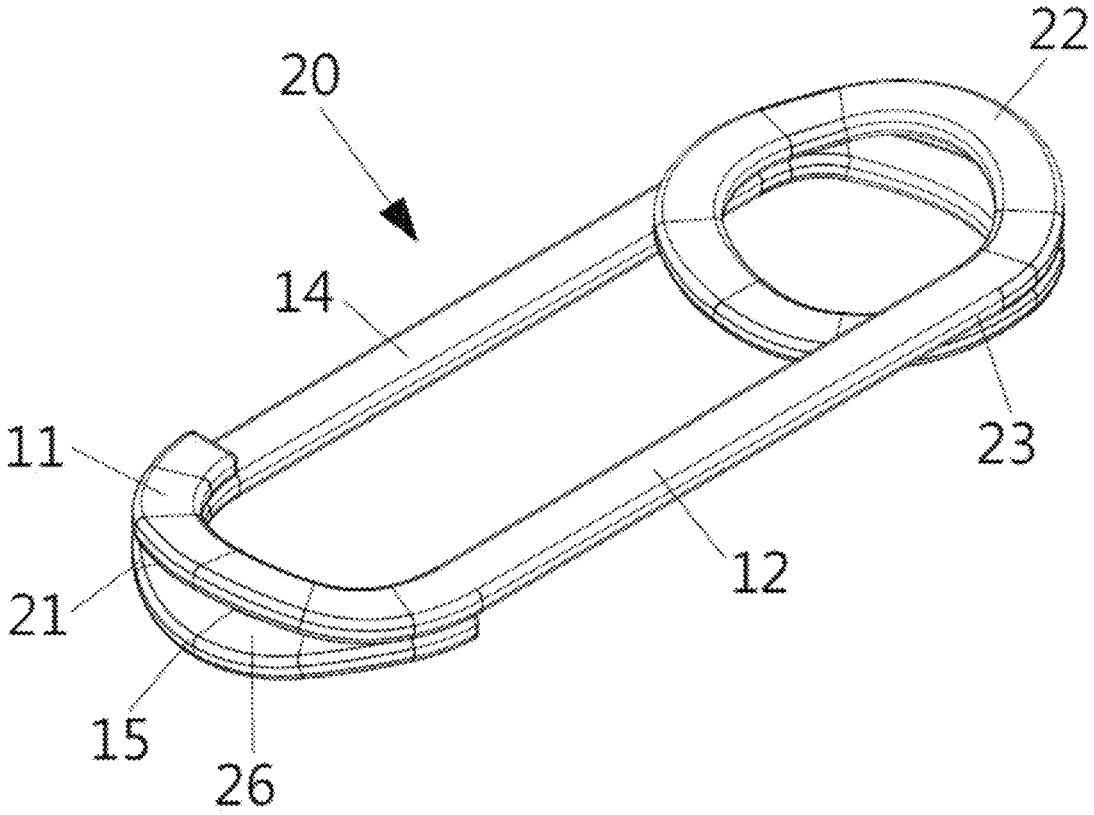

In the third embodiment shown in FIGS. 3A-3B, the first end portion 11 and the second end portion 15 of the keyring holder 1 are arranged to abut against each other when no force is applied, but they are spaced in part from each other in the upward-downward direction, preferably at the positions where the first end portion 11 and the second end portion 15 are bent over, thereby defining a separate portion for receiving insertion of a key or a ring. More preferably, the first end portion 11 and the second end portion 15 are outwardly curved at the separate portion 26, as a means to receive insertion of a key or a ring. By virtue of the separate portion 26, the keyring holder 1 according to the invention may be operated in another way, as shown in FIGS. 4A-4D.

Figure 4A:
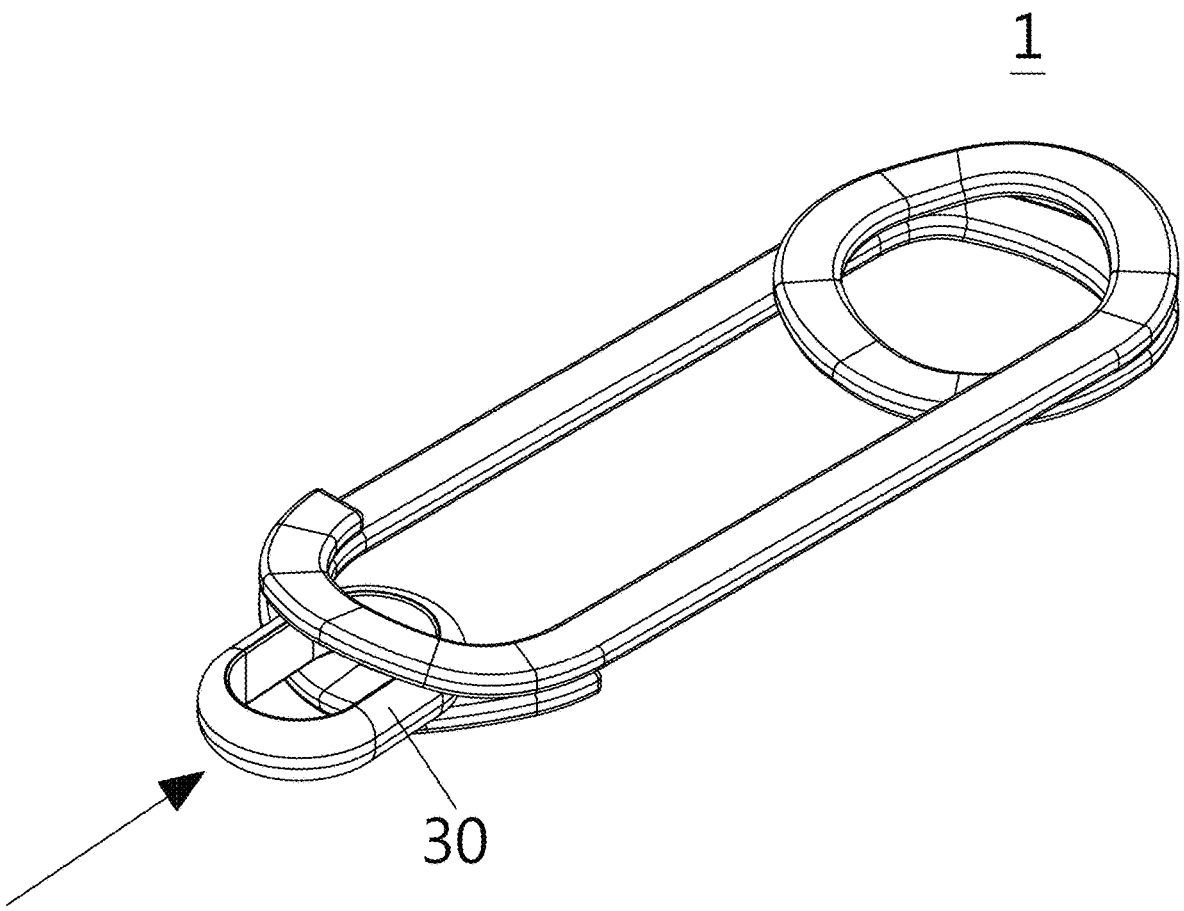
FIGS. 4A-4D are schematic diagrams showing a process of importing a key into the keyring holder according to the third embodiment of the invention.
Figure 4B:
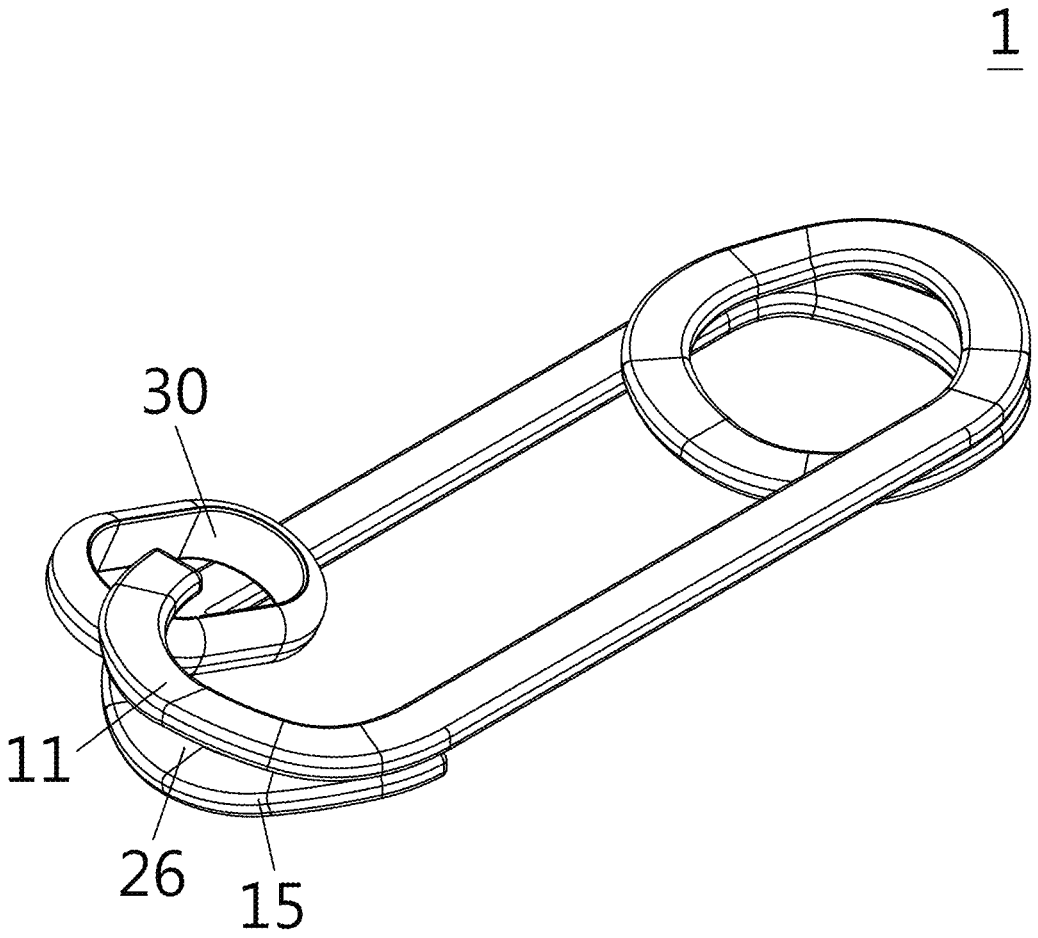
Figure 4C:
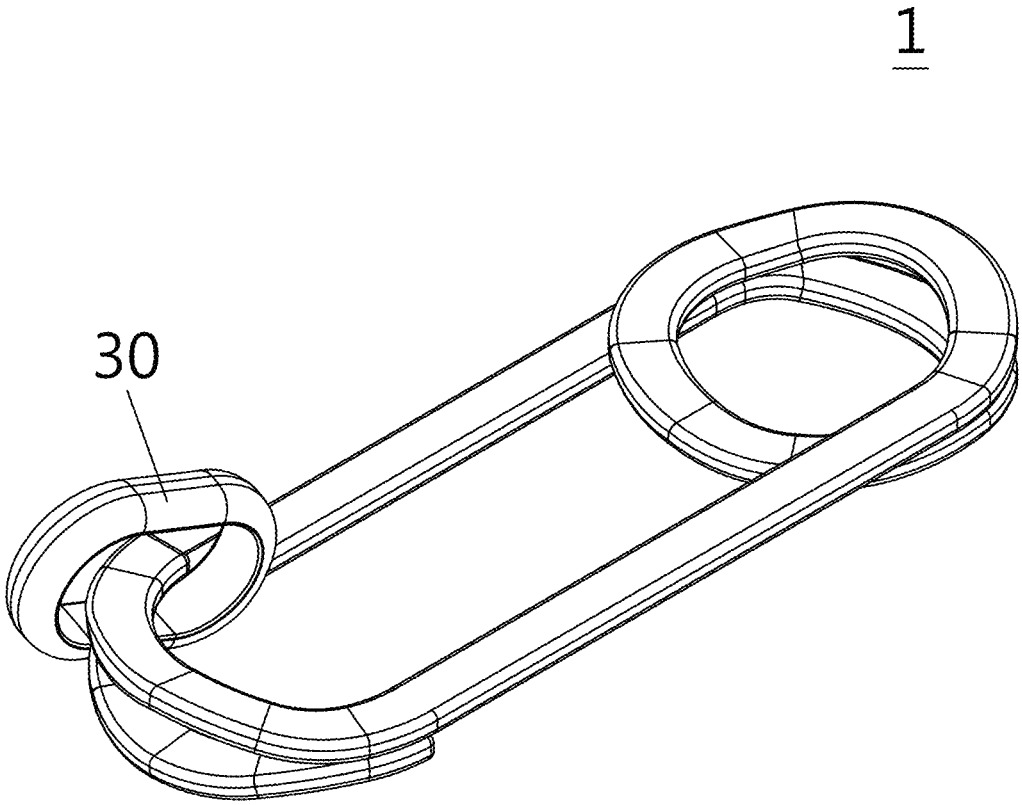
Figure 4D:
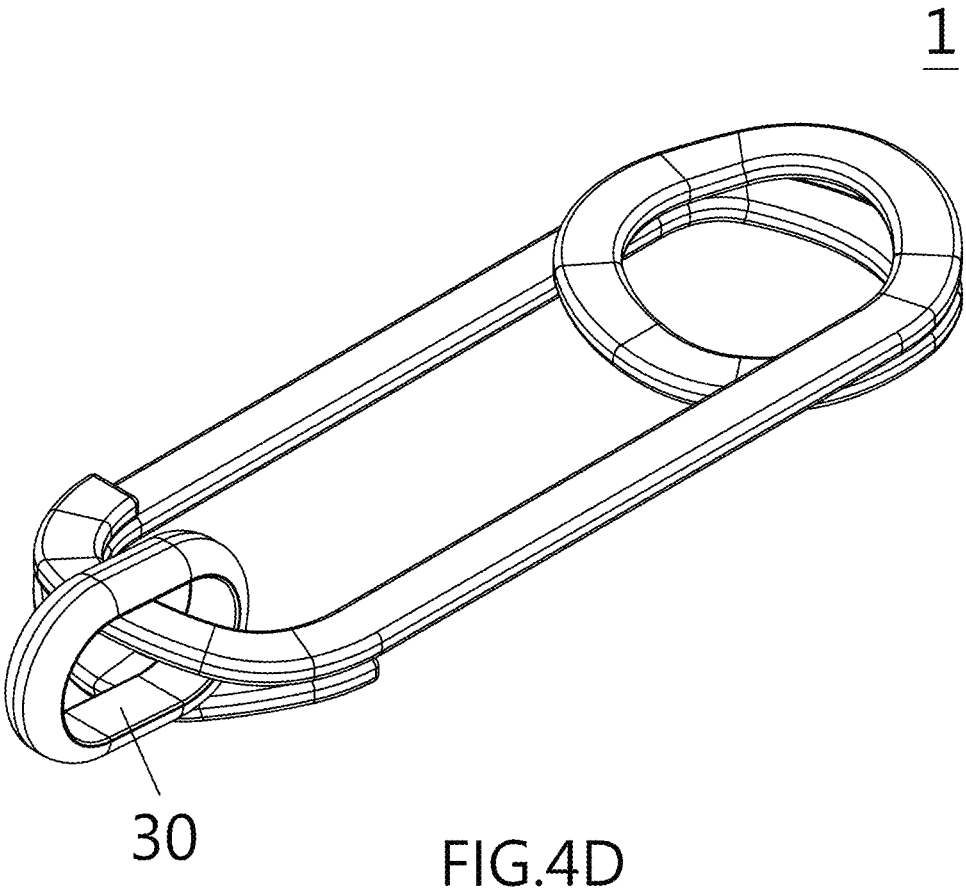
Figure 5:
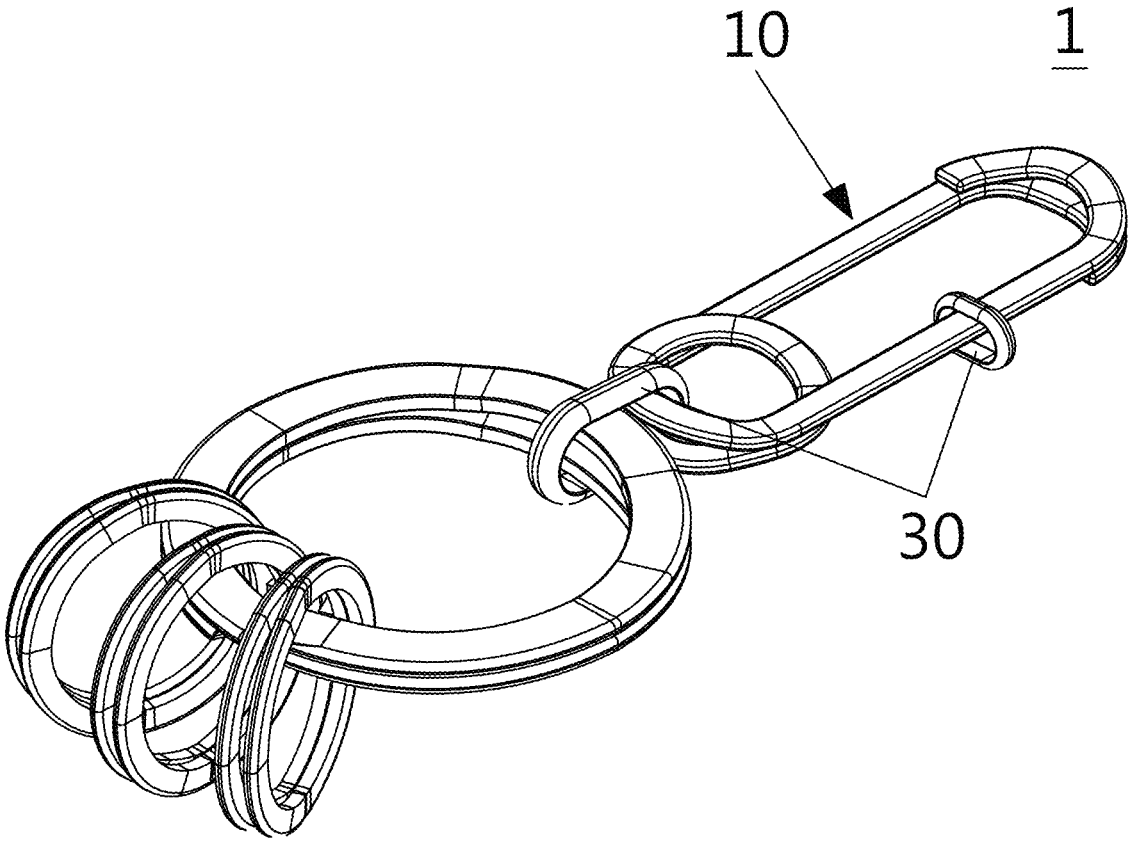
FIG. 5 is a schematic diagram showing that the keyring holder according to the third embodiment of the invention is in use.

In FIGS. 4A-4D, a ring 30 is taken as an example to illustrate a process of operating the keyring holder 1. In FIG. 4A, the ring 30 is partially inserted into the separate portion 26. At the time, the first end portion 11 and the second end portion 15 are not subjected to considerable force. In FIG. 4B, the ring 30 is moved horizontally along the separate portion 26 to reach the free end of the first end portion 11, where the first end portion 11 and the second end portion 15 are forced to separate away from each other. The hole of the ring 30 is registered with the free end of the first end portion 11. In FIG. 4C, the ring 30 is twisted to separate the first end portion 11 from the second end portion 15 further, and the ring 30 is introduced into the free end of the first end portion 11. In FIG. 4D, the ring 30 is moved horizontally along the separate portion 26, so that the ring 30 is introduced into the lower loop 16 and even the upper loop 13. At the time, the first end portion 11 and the second end portion 15 are no longer subjected to an external force and return to their original abutting state. As shown in FIG. 5, through the operating process above, the keyring holder 1 can stably hold a lot of rings or keys, and additional rings or keys may be hung up subsequently through the rings which have already been held. Moreover, the user can open the entry port without pressing the press portion 25 by way of the operating process above, which increases convenience in use.

Similar to the first and second embodiments, the third preferred embodiment according to the invention comprises two pivot points 23, 24, both being disposed proximal to the second section 22 and distal to the first end portion 11 and the second end portion 15 which constitute the first section 21. According to the principle of leverage, the longer the distance between the first section 21 and the pivot points 23, 24, the smaller the force needed for levering the first end portion 11 away from the second end portion 15 through the operation shown in FIGS. 4B-4C. In other words, in the third embodiment of the invention, the structural feature of distal positioning of the pivot points 23, 24 in relation to the first section 21 works synergistically with the elongated configuration of the lower loop 16, leading to a labor-saving effect during the process of inserting a key or a ring into the separate portion 26.

Figure 6A:
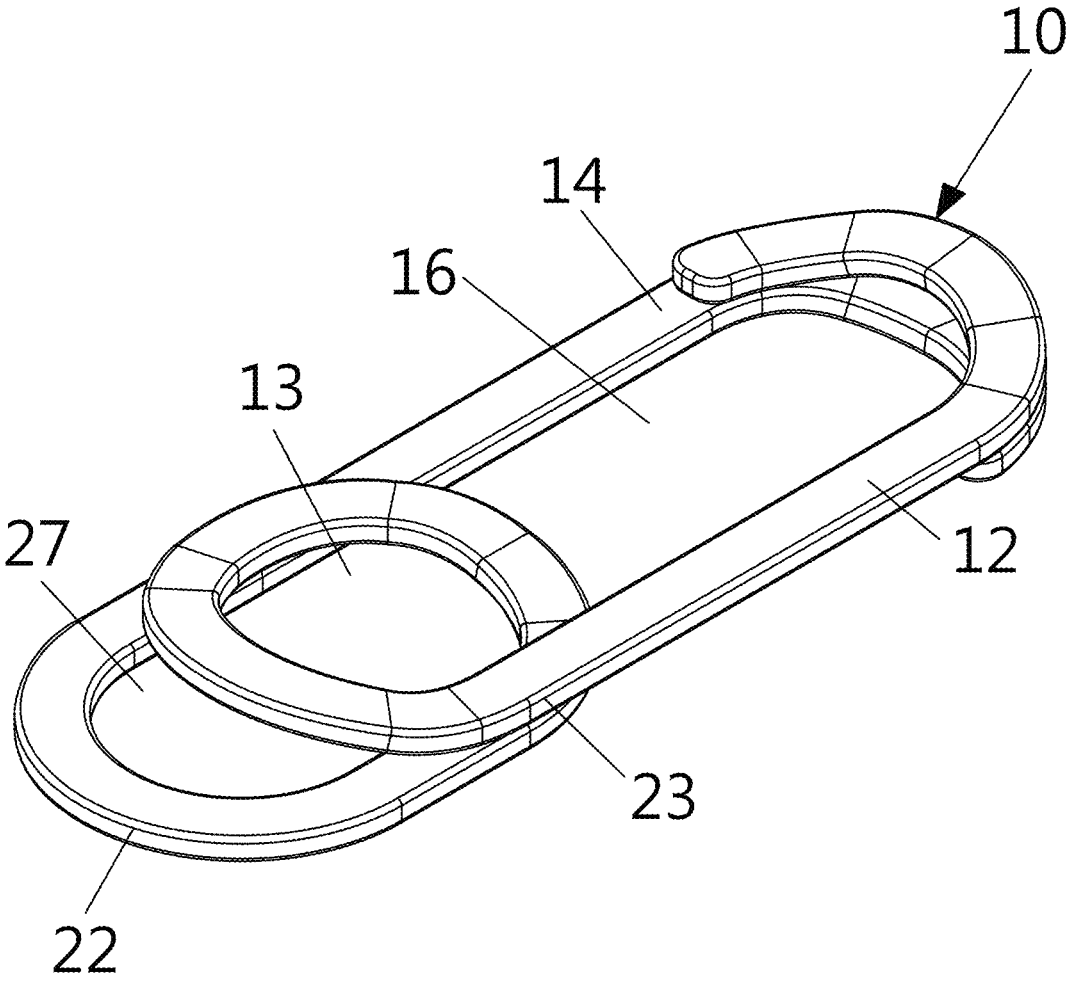
FIGS. 6A-6B are schematic perspective diagrams of the keyring holder according to the fourth embodiment of the invention.
Figure 6B:
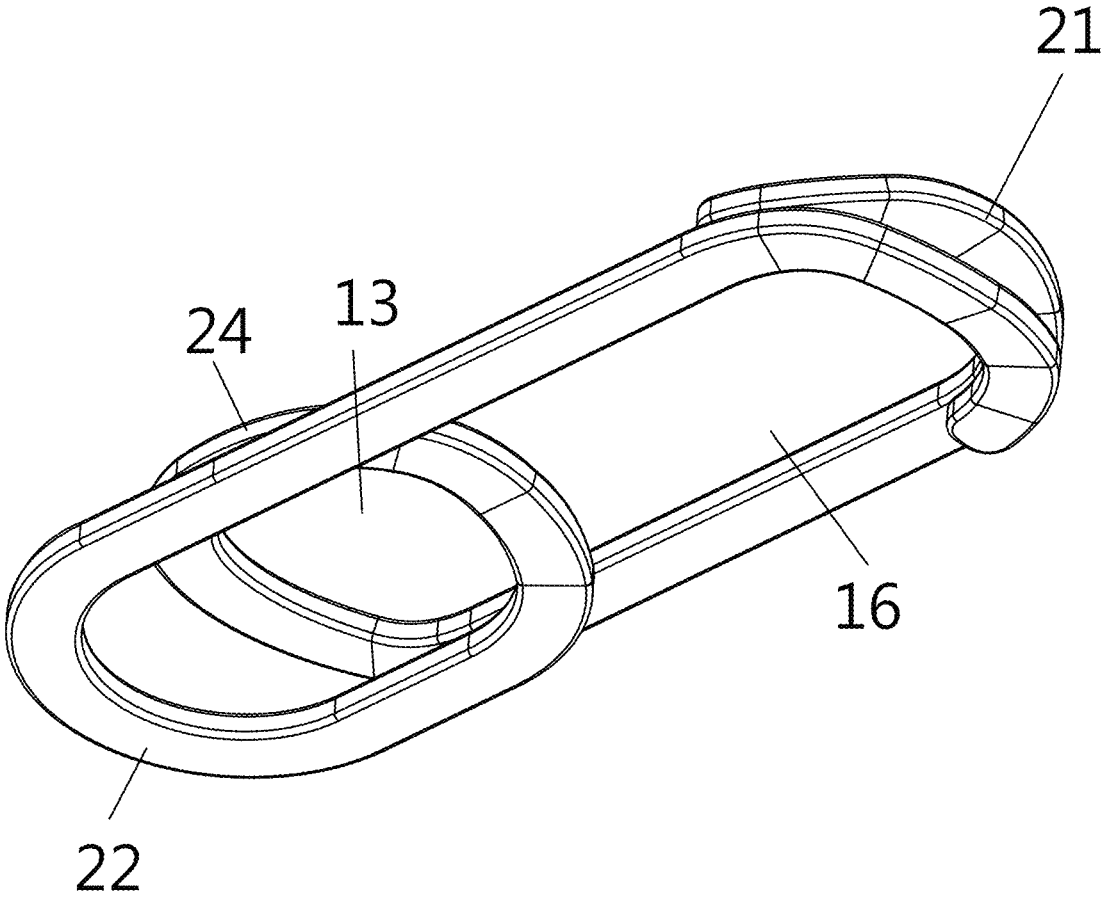
Figure 7:
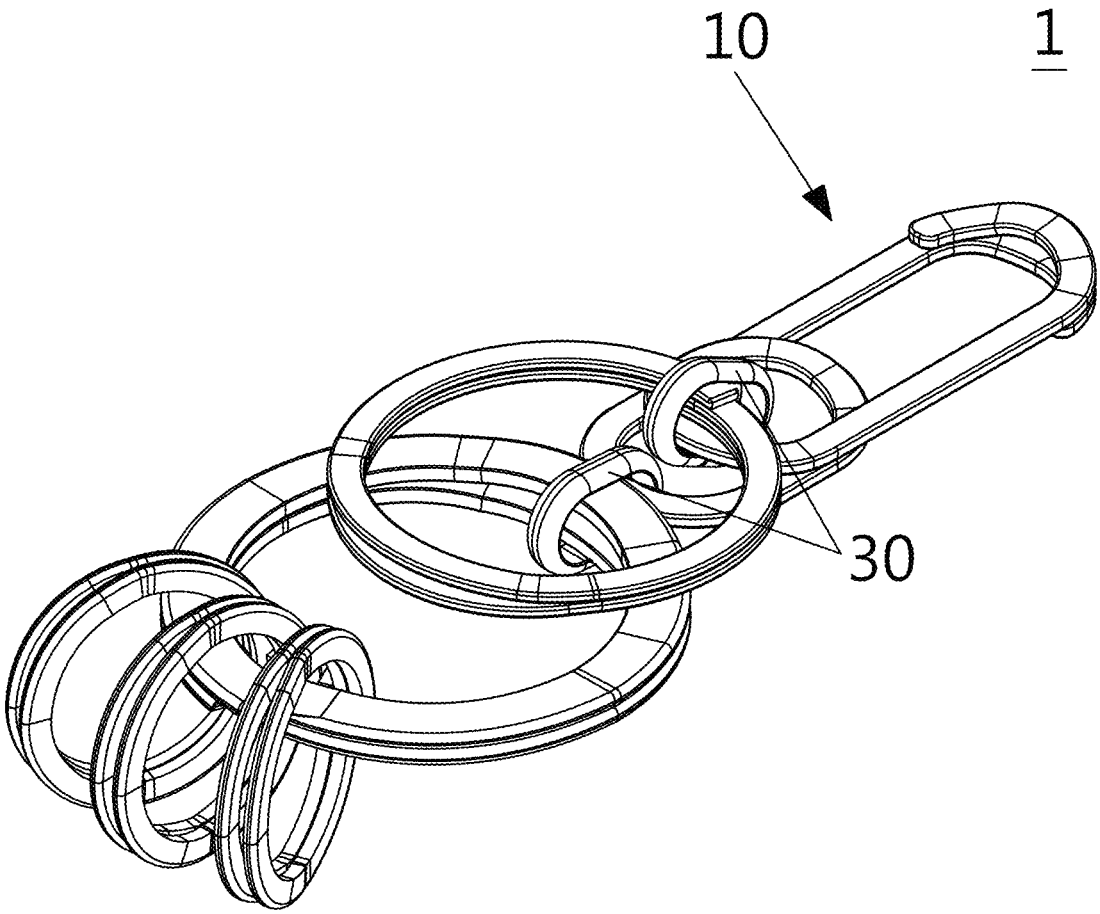
FIG. 7 is a schematic diagram showing that the keyring holder according to the fourth embodiment of the invention is in use.

In the first embodiment shown in FIGS. 1A-1B, the second embodiment shown in FIG. 2, and the third embodiment shown in FIGS. 3A-3B, the upper loop 13 is arranged to be superimposed in the upward-downward direction X at the second section 22, so that the pivot points 23, 24 are located at junctures of the second section 22 and the side sections 12, 14. Alternatively, according to the fourth preferred embodiment shown in FIGS. 6A-6B, the upper loop 13 may be so arranged that it is not superimposed over the second section 22 in the upward-downward direction X. As a result, the pivot points 23, 24 are located on the side sections 12 and 14, creating a gap 27 in the horizontal direction Y substantially perpendicular to the upward-downward direction X. In this embodiment, since the upper loop 13 and the lower loop 16 are not superimposed in the upward-downward direction X at the gap 27, it would provide additional positions for holding items and be more versatile in use as shown in FIG. 7, in comparison with the first embodiment.

Figure 8A:
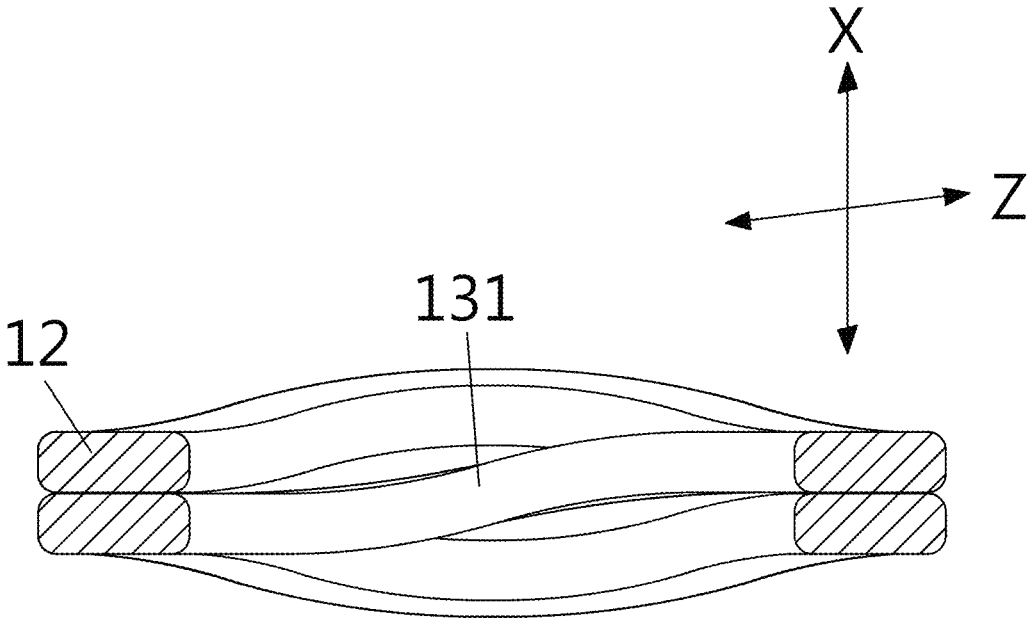
FIG. 8A is a schematic left side view of the cross-section taken along the A-A' line in FIG. 1C.
Figure 8B:
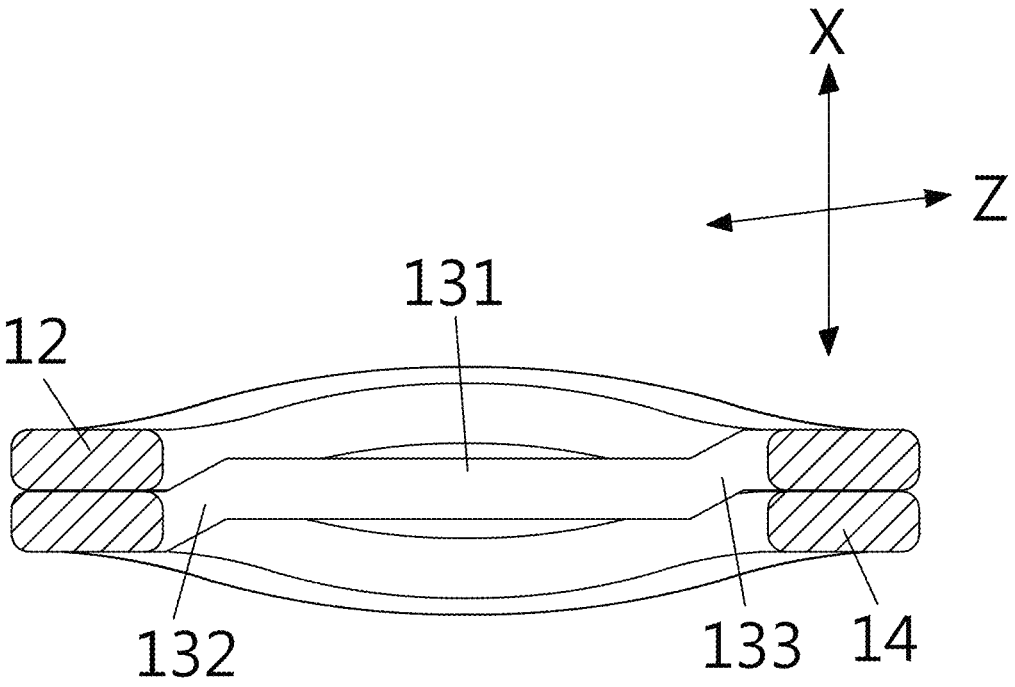
FIG. 8B is a schematic diagram of a modified cross-section similar to that of FIG. 8A.

FIG. 8A is a schematic left side view of the cross-section taken along the A-A' line in FIG. 1C, showing that the upper loop 13 includes a half loop 131 which is wound spirally downwards and intersects the side section 12 to close up the upper loop 13. The half loop 131 is shown to extend at an angle with respect to a horizontal direction Z substantially perpendicular to the upward-downward direction X. FIG. 8B is a schematic diagram of a modified cross-section similar to that shown in FIG. 8A, in which the half loop 131 is bent slightly along the upward-downward direction X to constitute stop portions 132, 133. As a result, the half loop 131 is arranged to extend in the horizontal direction Z, while the stop portions 132, 133 are arranged in contact with or very close to the two side sections 12, 14, as a means to prevent the items held in the lower loop 16 from accidentally sliding into the upper loop 13.

While the invention has been described with reference to the preferred embodiments above, it should be recognized that the preferred embodiments are given for the purpose of illustration only and are not intended to limit the scope of the present invention and that various modifications and changes, which will be apparent to those skilled in the relevant art, may be made without departing from the spirit and scope of the invention.

What is claimed is:

1. A keyring holder comprising:

an integrally formed resilient ring body, wound spirally downwards from a first end portion extending continuously and terminated at a second end portion;

wherein the ring body comprises a first section constituted by the first end portion and the second end portion, a second section arranged opposite to the first section, and two side sections connecting the first section to the second section, and wherein the first end portion and the second end portion are configured to abut against each other in an upward-downward direction when the ring body is not subjected to an external force; and wherein a lower loop is proximal to the first section and an upper loop is proximal to the second section, the lower loop is substantially greater than the upper loop in terms of areas enclosed thereby and is arranged in contact with the upper loop on the two side sections at two pivot points proximal to the second section, and wherein the second section has a gap in the upward-downward direction to constitute a press portion facing towards the second section, so that the first end portion is levered upward about the two pivot points to move away from the second end portion as the press portion is forced to move downward.

2. The keyring holder according to claim 1, wherein the ring body is made from a wire having a substantially constant thickness and a substantially rectangular cross-section throughout its length.

3. The keyring holder according to claim 2, wherein the wire has a width perpendicular to the thickness and the thickness is substantially less than the width.

4. The keyring holder according to claim 3, wherein the first end portion and the second end portion are configured so that the first end portion is superimposed over the second end portion.

5. The keyring holder according to claim 4, wherein the first end portion and the second end portion are both configured in a hook shape with their free ends pointing towards the second section.

6. The keyring holder according to claim 5, wherein the first end portion is spaced in part from the second end portion in the upward-downward direction to define a separate portion for receiving insertion of a key.

7. The keyring holder according to claim 6, wherein the first end portion and the second end portion are outwardly curved at the separate portion.

8. The keyring holder according to claim 5, wherein the upper loop comprises a half loop wound spirally downwards and closing up the upper loop by intersecting one of the side sections, and wherein the half loop is bent along the upward-downward direction to constitute at least one stop portion, so that the half loop is arranged to extend in a horizontal direction substantially perpendicular to the upward-downward direction and the at least one stop portion is arranged in contact with at least one of the two side sections, thereby preventing any item held in the lower loop from accidentally sliding into the upper loop.

9. The keyring holder according to claim 5, wherein the two side sections are arranged parallel to each other.

10. The keyring holder according to claim 5, wherein the two side sections are arranged non-parallel to each other.

* * * * *